US006454261B2

(12) United States Patent
Ohira

(10) Patent No.: US 6,454,261 B2
(45) Date of Patent: Sep. 24, 2002

(54) GAME MACHINE

(75) Inventor: Teruo Ohira, Gifu (JP)

(73) Assignee: Ohiragiken Industry Co., Gifu (JP)

( * ) Notice: Subject to any disclaimer, the term of this patent is extended or adjusted under 35 U.S.C. 154(b) by 0 days.

(21) Appl. No.: 09/841,370

(22) Filed: Apr. 23, 2001

(30) Foreign Application Priority Data

May 25, 2000 (JP) ..... 2000-154019
Dec. 8, 2000 (JP) ..... 2000-374271

(51) Int. Cl.[7] ..... A63F 9/00

(52) U.S. Cl. ..... 273/140; 273/448; 273/456; 273/138.2

(58) Field of Search ..... 273/140, 447, 273/448, 456, 457, 138.2, 138.5

(56) References Cited

U.S. PATENT DOCUMENTS 1,910,863 A * 5/1933 Sullivan ..... 273/140
3,106,394 A * 10/1963 Gelbart ..... 273/140
3,627,316 A * 12/1971 Machinski ..... 273/109
3,788,641 A * 1/1974 Lemelson ..... 273/140
4,272,075 A * 6/1981 Rogers, Jr. ..... 273/140
4,432,544 A * 2/1984 Wakimura ..... 273/140
5,615,881 A * 4/1997 Potter ..... 273/140

* cited by examiner

*Primary Examiner*—Benjamin H. Layno
*Assistant Examiner*—Vishu K Mendiratta
(74) *Attorney, Agent, or Firm*—Beyer Weaver & Thomas, LLP

(57) ABSTRACT

A game machine played by a player to fish amusement objects. The game machine has a tank containing water. The amusement objects float on water. A fishing member engages one of the amusement objects and fishes the amusement object. The fishing member is lifted to catch the amusement object. A driving mechanism supports the fishing member and vertically moves the fishing member. A forcible object mover forcibly moves the amusement objects on the water surface. A manipulator, which is manipulated by the player, lowers the fishing member with the driving mechanism. A dropping mechanism drops the amusement object when the amusement object is lifted together with the fishing member by the driving mechanism.

20 Claims, 14 Drawing Sheets

GAME MACHINE

BACKGROUND OF THE INVENTION

The present invention relates to a game machine for lifting amusement objects floating on water.

In the prior art, there is a game machine that accommodates a plurality of prizes in a prize accommodating compartment. A player externally manipulates an arm to lift and carry the prizes from the prize accommodating compartment to a predetermined position, at which the prizes are awarded to the player. Such game machine is referred to as a crane game machine. The crane game machine is played in the following manner. The player pushes a button, which is located outside the prize accommodating compartment, to move the arm, which is located in the prize accommodating compartment, in a horizontal direction (in the left, right, forward, and backward directions) to a position where a desired prize is located. The arm is then automatically lowered to perform a grasping action. If the arm is located at an appropriate position, the arm grasps a prize. The arm is then lifted. Upon completion of the lifting action, the arm is horizontally moved to the vicinity of a prize discharge port. The arm then releases and drops the prize. This discharges the prize from the prize accommodating compartment through the prize discharge port.

However, the above conventional game machine has a few shortcomings. For example, the player moves only the arm in the prize accommodating compartment. Thus, the player performs only a few manipulations. As a result, playing the game machine and watching the game machine being played may become somewhat boring.

Since the game machine is played by moving the arm to a position above a stationary prize, there is a lack of excitement for retrieving a prize. This may result in the game machine being somewhat boring.

SUMMARY OF THE INVENTION

It is an object of the present invention to provide a game machine that is exciting and amusing.

To achieve the above object, the present invention provides a game machine having a play area partitioned from an external environment. A player manipulates the game machine in the external environment to play a predetermined game while conditions in the play area change. The game machine includes a tank containing liquid, an amusement object that floats on the surface of the liquid, and a fishing member that engages the amusement object and fishes the amusement object. The fishing member is lifted to catch the amusement object. A driving mechanism supports the fishing member and vertically moves the fishing member. A forcible object mover forcibly moves the amusement object on the liquid surface. A manipulator, which is manipulated by the player, lowers the fishing member with the driving mechanism. A dropping mechanism drops the amusement object when the amusement object is lifted together with the fishing member by the driving mechanism.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

A game machine according to a first embodiment of the present invention will now be described with reference to the drawings.

Figure 1:
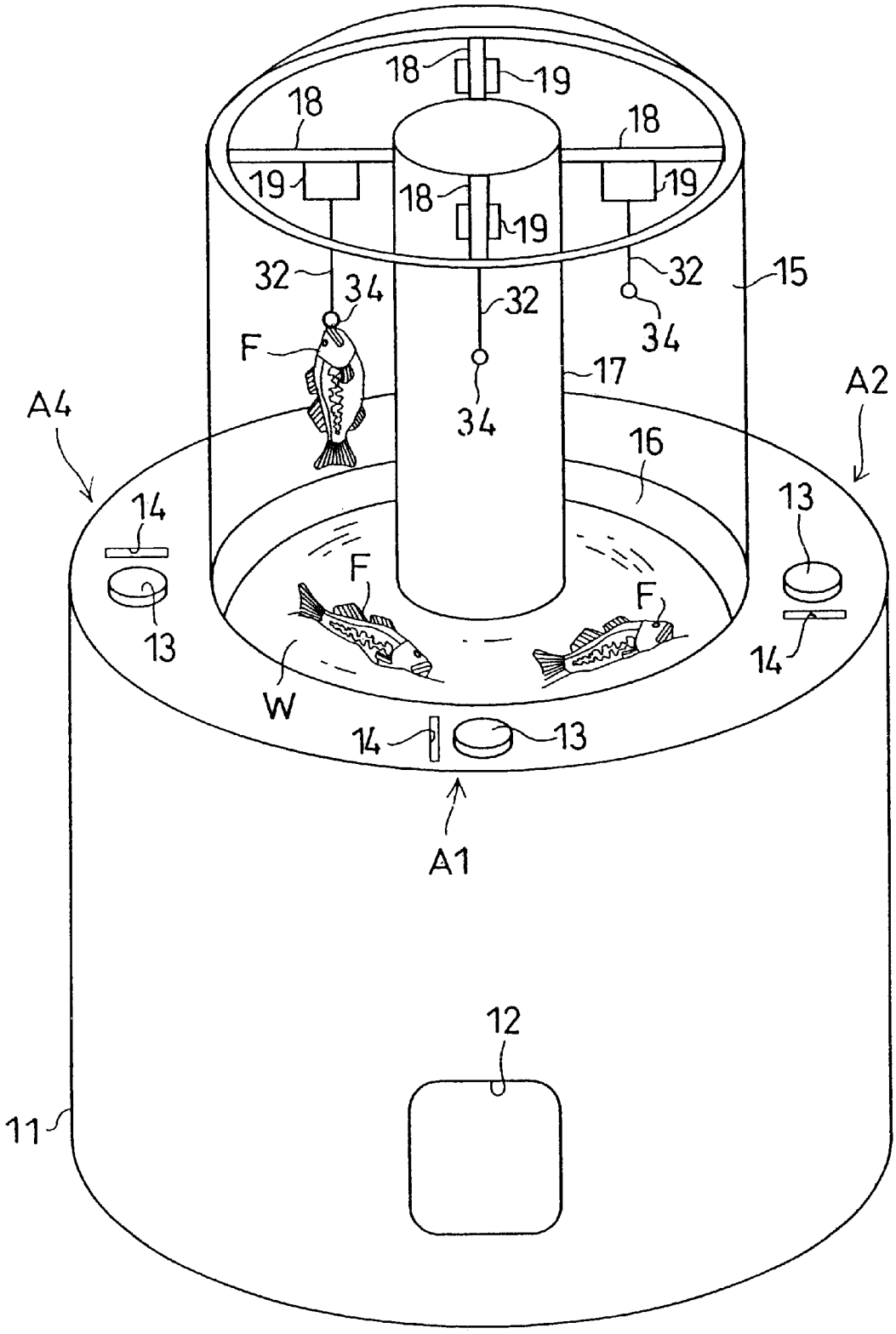
FIG. 1 is a perspective view showing a game machine according to a first embodiment of the present invention.
Figure 2A:
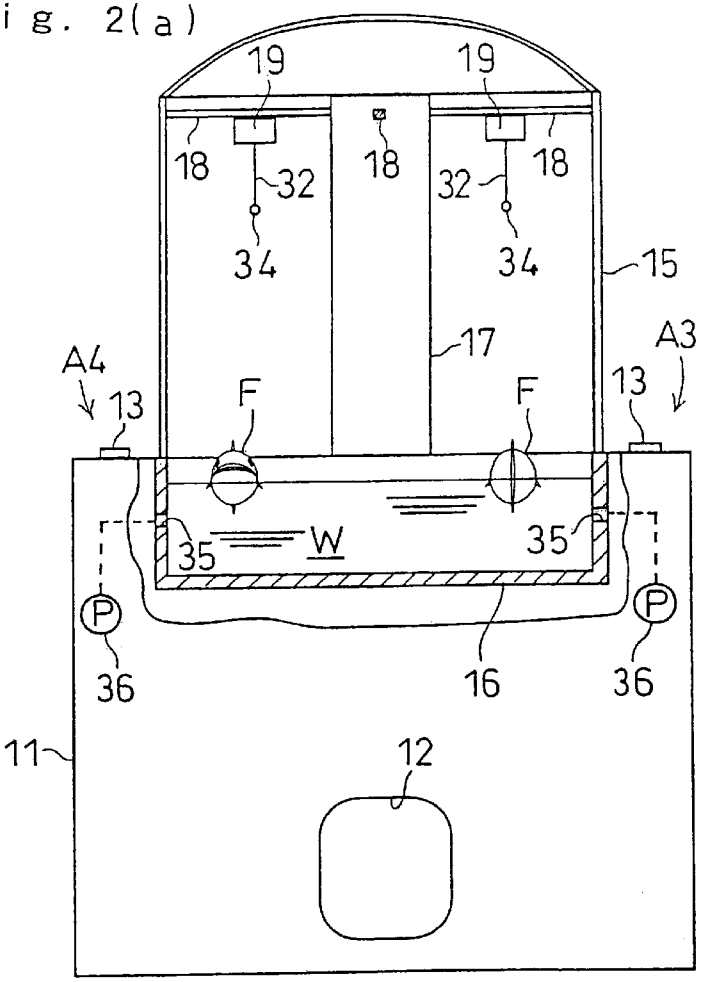
FIG. 2(*a*) is a front view showing the game machine of FIG. 1, and FIG. 2(*b*) is a plan view showing the game machine of FIG. 1.
Figure 2B:
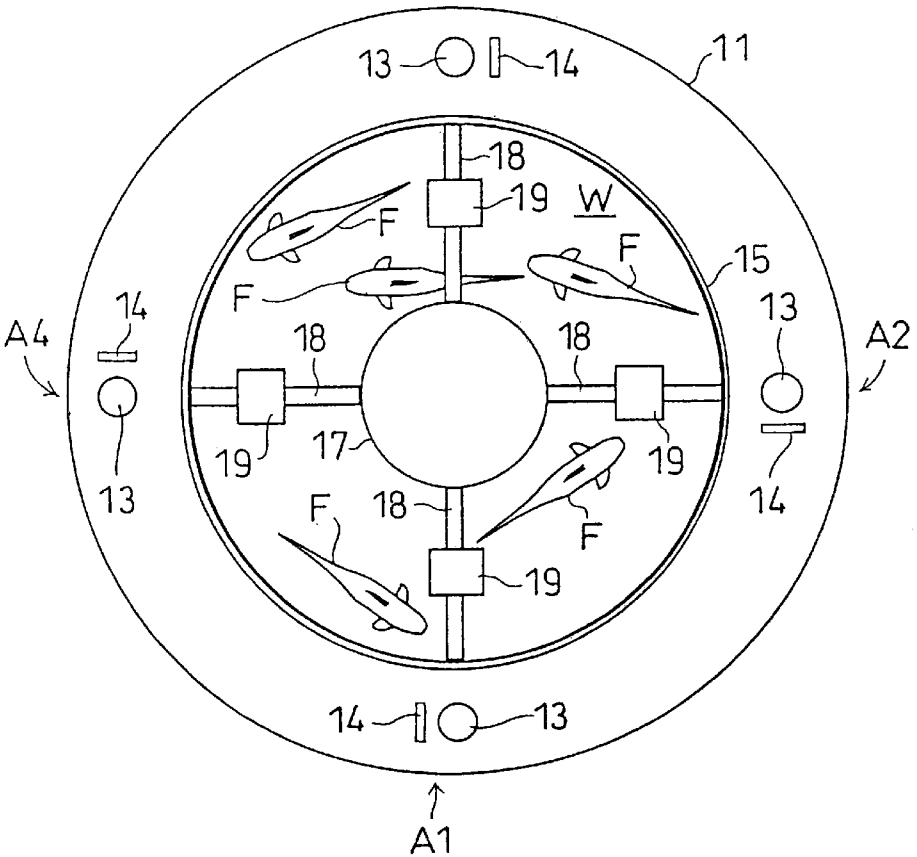

As shown in FIGS. 1 and 2, a generally cylindrical base 11 accommodates a plurality of prizes (not shown). A cylindrical transparent cover 15 is fixed to the upper surface of the base 11. A water tank 16, which diameter is substantially the same as that of the transparent cover 15, is arranged at an upper portion of the base 11 in correspondence with the cover 15. A cylindrical pillar 17 extends from the center of the water tank 16.

Four equally spaced play areas A1, A2, A3, A4 are defined in the peripheral section of the base 11. A prize discharge port 12 is provided for each of the play areas A1–A4 at a lower portion of the base. When a player plays a game at one of the play areas A1–A4 and is awarded a prize, the prize is discharged through the associated prize discharge port 12. A button 13 and a coin slot 14 are also provided for each play area A1–A4 on the upper surface of the base 11.

Four equally spaced bars 18 extend between an upper portion of the pillar 17 and the inner wall of the transparent cover 15. Each bar 18 is associated with one of the play areas A1–A4. A reel 19, which serves as a fishing member, is fixed to each bar 18.

Figure 3:
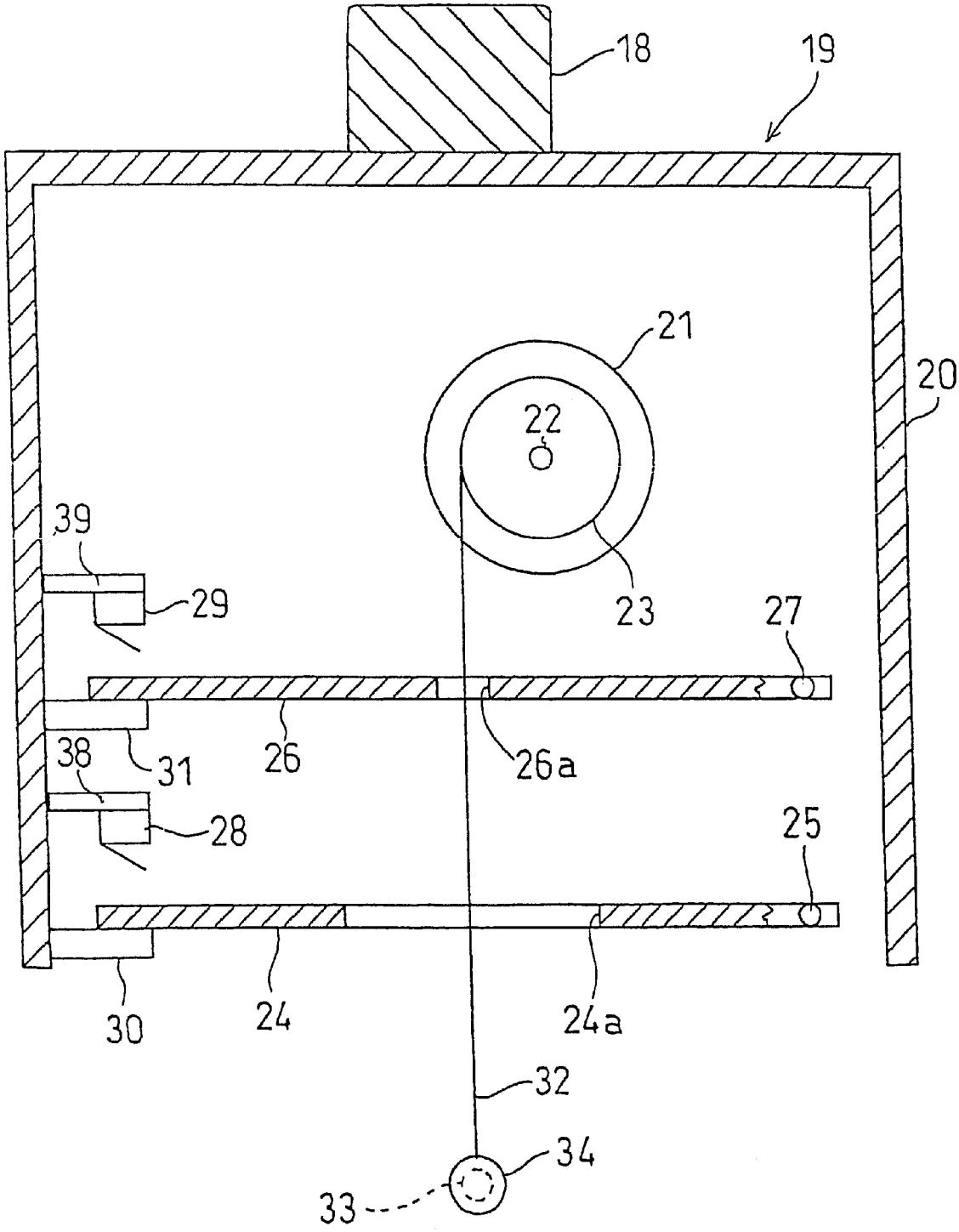
FIG. 3 is a front cross-sectional view showing a reel.
Figure 4:
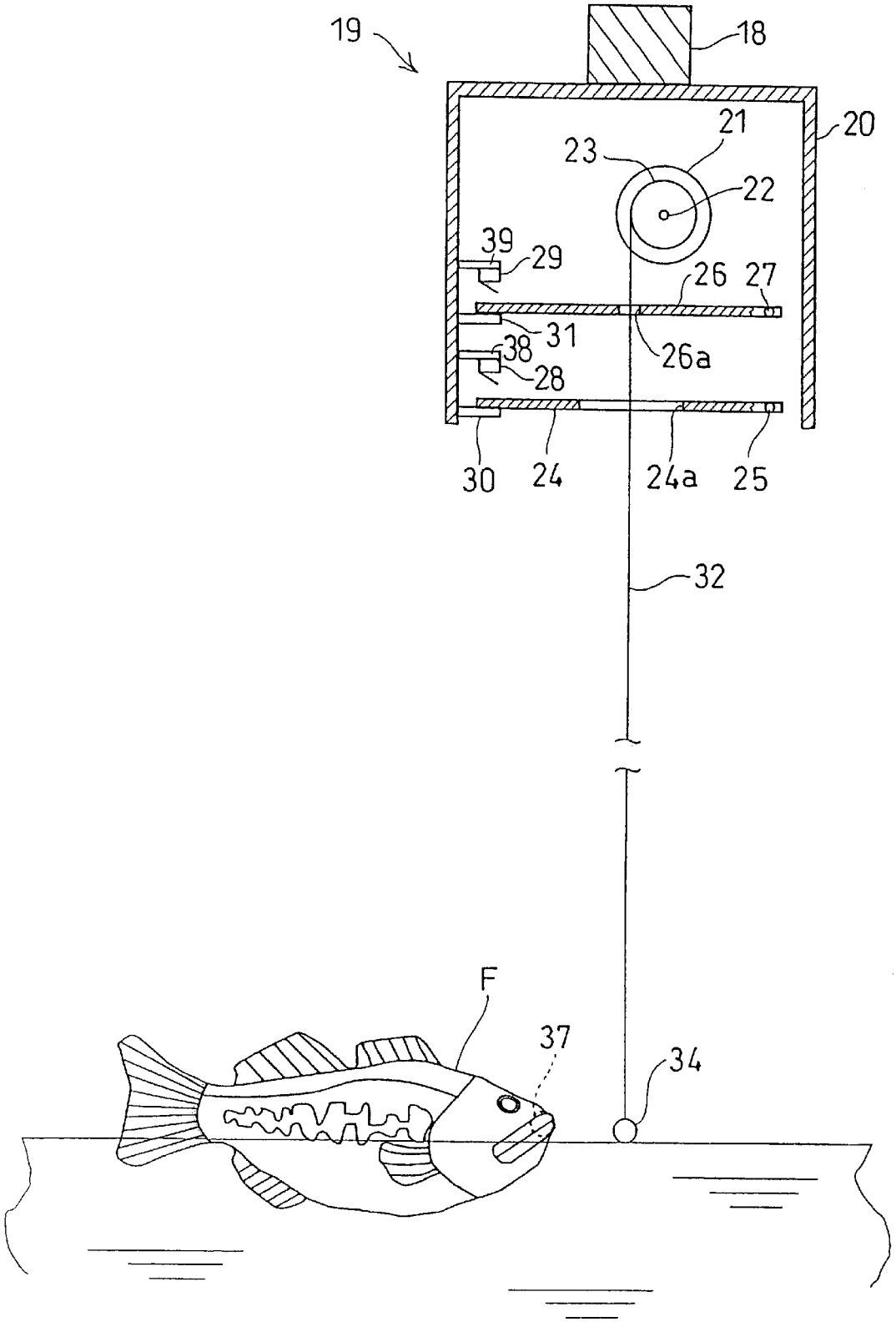
FIG. 4 is a front cross-sectional view showing a water tank and the reel.
Figure 5A:
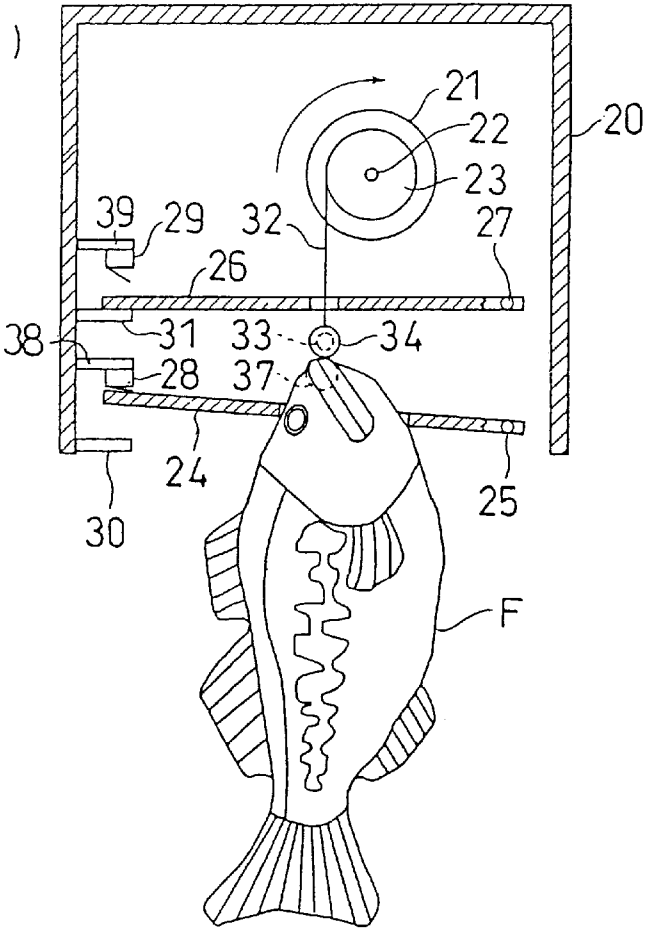
FIG. 5(*a*) is a front cross-sectional view showing the reel in a state in which a first limit switch is activated by a caught fish, and FIG. 5(*b*) is a cross-sectional view showing the reel in a state in which a second limit switch is activated with a fishing line further wound to the reel from the state of FIG. 5(*a*)
Figure 5B:
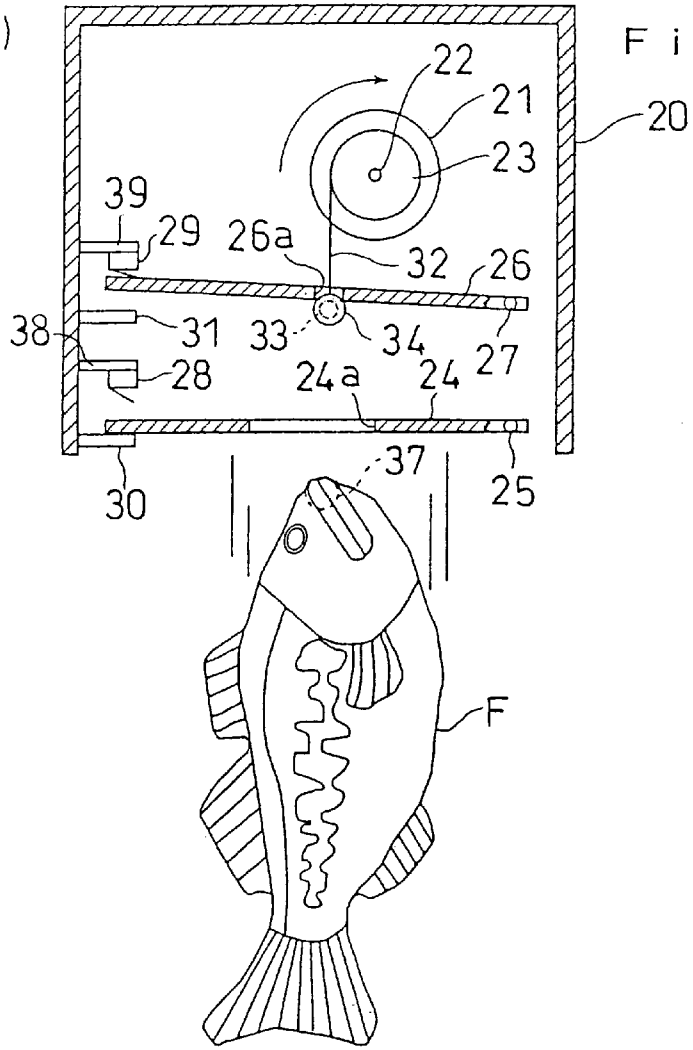

With reference to FIG. 3, a motor 21 is secured to a case 20 of the reel 19. The motor 21 has a drive shaft 22, which supports a drum 23 so that the drum 23 is rotated integrally with the drive shaft 22. A first plate 24, which is pivotally supported about a shaft 25, is arranged at a lower section of the case 20. The first plate 24 serves as a disengaging mechanism. A second plate 26 is arranged between the first plate 24 and the drum 23. The second plate 26 is pivotally supported about a shaft 27.

A first restricting plate 38 and a second restricting plate 39 are arranged in the case 20 on an inner wall so as to respectively oppose the distal ends of the plates 24, 26. A first limit switch 28 is attached to a lower surface of the restricting plate 38, and a second limit switch 29 is attached to a rear surface of the second restricting plate 39. Contact between the plates 24, 26 and the associated restricting plates 38, 39 restrict upward pivoting (pivoting in the clockwise direction as viewed in FIG. 3) of the plates 24, 26.

Stoppers 30, 31 are fixed below the plates 24, 26, respectively. Contact between the plates 24, 26 and the stoppers 30, 31 restrict downward pivoting of the plates 24, 26. The plates 24, 26 contact the associated limit switches 28, 29 when the plates 24, 26 are pivoted upward. This causes each of the limit switches 28, 29 to output an ON signal.

Holes 24*a*, 26*a* extends through central portions of the first and second plates 24, 26, respectively. The holes 24*a*, 26*a* have different diameters. A basal end of a fishing line 32 is secured to the drum 23. A ball 34 is secured to a distal end of the line 32. A permanent magnet 33 is embedded in the ball 34. When the drum 23 is rotated in the clockwise direction as viewed in FIG. 3, the line 32 is wound to the drum 23. On the other hand, when the drum 23 is rotated in the counterclockwise direction, the line 32 is drawn out of the drum 23. The hole 24*a* of the first plate 24 has a diameter that is larger than the diameter of the ball 34. The hole 26*a* of the second plate 26 has a diameter that is smaller than the diameter of the ball 34.

In a standby state (a state in which the game is not being played), the two plates 24, 26 are held in a horizontal state as viewed in FIG. 3. In the standby state, the ball 34 is still. Further, in this state, the line 32 is wound to the drum 23 and the ball 34 is arranged at the upper portion of the transparent cover 15.

With reference to FIGS. 1 and 2, water W is contained in the water tank 16. Four equally spaced air injection ports 35 are arranged in the side wall of the water tank 16. An air pump 36 is connected to the inlet of each air injection port 35. The air pump 36 generates a current in the water tank 16 that swirls the water W in the counterclockwise direction. Further, the air pump 36 is constantly driven regardless of whether the game machine is in a standby state or whether the game machine is being played. In the preferred and illustrated embodiment, the air injection ports 35 and the air pumps 36 function as a forcible object mover.

A plurality of fishes (model fishes) F float on the water in the water tank 16. The upper portion (backs) of each fish F is exposed from the water surface, and the lower portion (abdomens) of each fish F is submerged below the water surface. Each fish F has a distal portion (mouth), in which a metal ball 37 is embedded. The metal ball 37 is made of a material that is attracted to a magnet, such as steel or stainless steel.

The main electric structure of the game machine will now be discussed.

Figure 6:
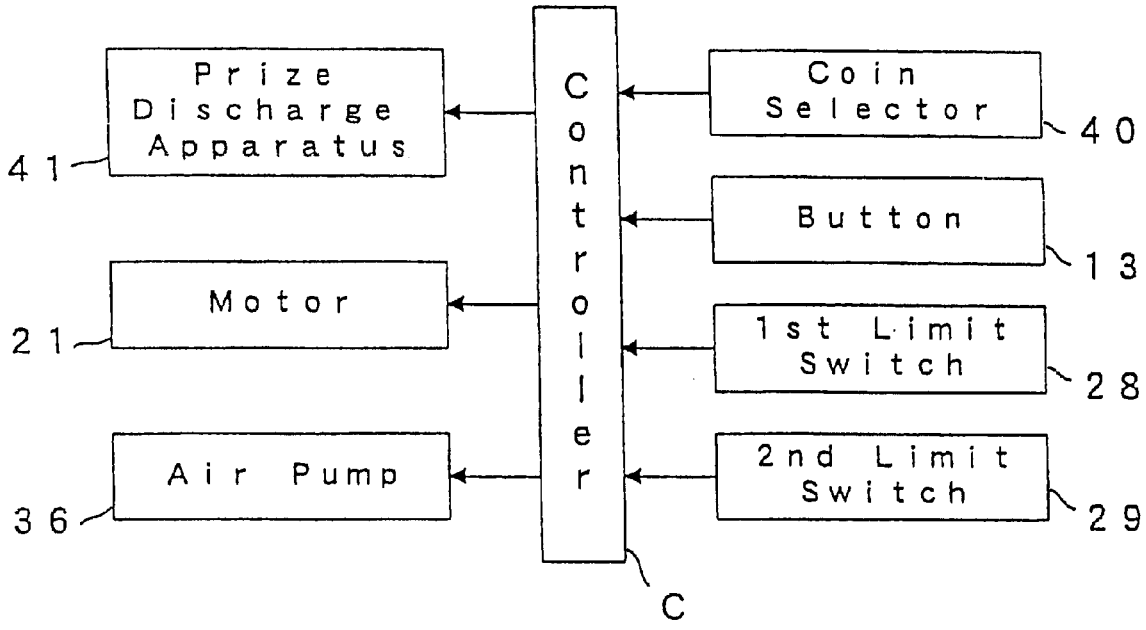
FIG. 6 is a block diagram illustrating the electric structure of the game machine of FIG. 1.

Referring to FIG. 6, a controller C, which performs various controls, is connected to the motors 21, a coin selector 40, the air pumps 40, the buttons 13, the first and second limit switches 28, 29, and a prize discharge apparatus 41. The coin selector 40 sends a coin insertion signal to the controller C when a coin is inserted into one of the coin slots 14. When the controller C receives the coin insertion signal, the controller C permits the input of signals from the associated button 13. When the button 13 sends a signal to the controller C, the controller C controls the corresponding motor 21 to rotate the drive shaft 22 by a predetermined amount in the counterclockwise direction, as viewed in FIG. 3. When a predetermined time elapses after rotating the drive shaft 22 by the predetermined amount, the controller C drives the motor 21 so as to activate the second limit switch 29. When the first limit switch 28 is activated, the controller C drives the prize discharge apparatus 41 to discharge a prize from the prize discharge port 12 of the play area A1–A4 associated with the activated switch 28.

The operation of the first embodiment will now be discussed.

To play the game machine, a player first inserts a coin in one of the coin slots 14. The insertion of a coin having a predetermined monetary value enables the associated button 13 to be manipulated so that the game machine may be played. After insertion of the coin, the player watches the positional relationship between the fishes F in the water tank 16 and the reel 19 of the play area A1–A4 in which the player is playing. When the button 13 is pushed, the associated motor 21 drives its reel 19 and draws out a predetermined amount of the line 32 from the drum 23. In other words, the ball 34 is lowered. The line 32 is drawn out of the reel 19 until the ball 34 reaches the water surface.

After a predetermined time (e.g., two seconds) elapses from when the ball 34 reaches the water surface, the motor 21 automatically starts to rotate the reel 19 in the reverse direction (clockwise direction) to wind the line 32 to the reel 19. This lifts the ball 34 from the water W. If magnetic force attracts and engages the mouth of one of the fishes F to the ball 34 when the ball 34 is on the water surface, the fish F is lifted together with the ball 34. As long as the fish F does not fall when the line 32 is wound, the head of the fish F contacts and lifts the first plate 24. The pivoting of the first plate 24 activates the first limit switch 28. In this state, it is assumed that the fish F has been successfully caught. Thus, the prize discharge apparatus 41 is driven to discharge a prize.

When the pivoting action of the first plate 24 is restricted, the motor 21 is further driven to lift the ball 34. The surface of the first plate 24 about the hole 24*a* prevents the fish F from being further lifted. Thus, the lifting of the ball 34 separates the mouth of the fish F from the ball 34 and drops the fish F into the water tank 16. The ball 34 continues to rise and contacts the surface of the second plate 26 surrounding the hole 26*a*. This lifts the second plate 26 until the second plate 26 activates the second limit switch 29. This stops the motor 21 and further winding of the line 32 to the reel 19.

The game machine according to the first embodiment has the advantages described below.

In the first embodiment, the movement of the fishes F and the reel 19, which serves as a fishing member, adds to the number of movements that must be confirmed when playing the game machine. This makes the game more amusing not only to the player but also to one watching the game machine being played.

In the first embodiment, the pressure of air applied to the water W generates a current in the water tank 16. The current forcibly moves the fishes F on the water surface in the water tank 16. Due to the current, the fishes F do not move in a regular manner. Thus, it is difficult for the player to predict the movement of the fishes F and determine the timing for pushing the button 13. This makes the game more amusing.

Magnetic force is used to engage a fish F with the ball 34, which is used to catch the fish F. In comparison with the prior art game machine, which uses an arm to grasp a prize, the structure for engaging an amusement object (fish F) to a fishing member (reel 19) is simplified. This reduces production costs.

After a fish F is caught, the fish F is automatically returned to the water tank 16. This seems as if a real fish F returns to the water tank 16 by itself and makes the game realistic and further amusing.

A game machine according to a second embodiment of the present invention will now be described with reference to the drawings. In the first and second embodiments, like elements are denoted with like reference numerals. Such elements will not be described in detail below.

Figure 7:
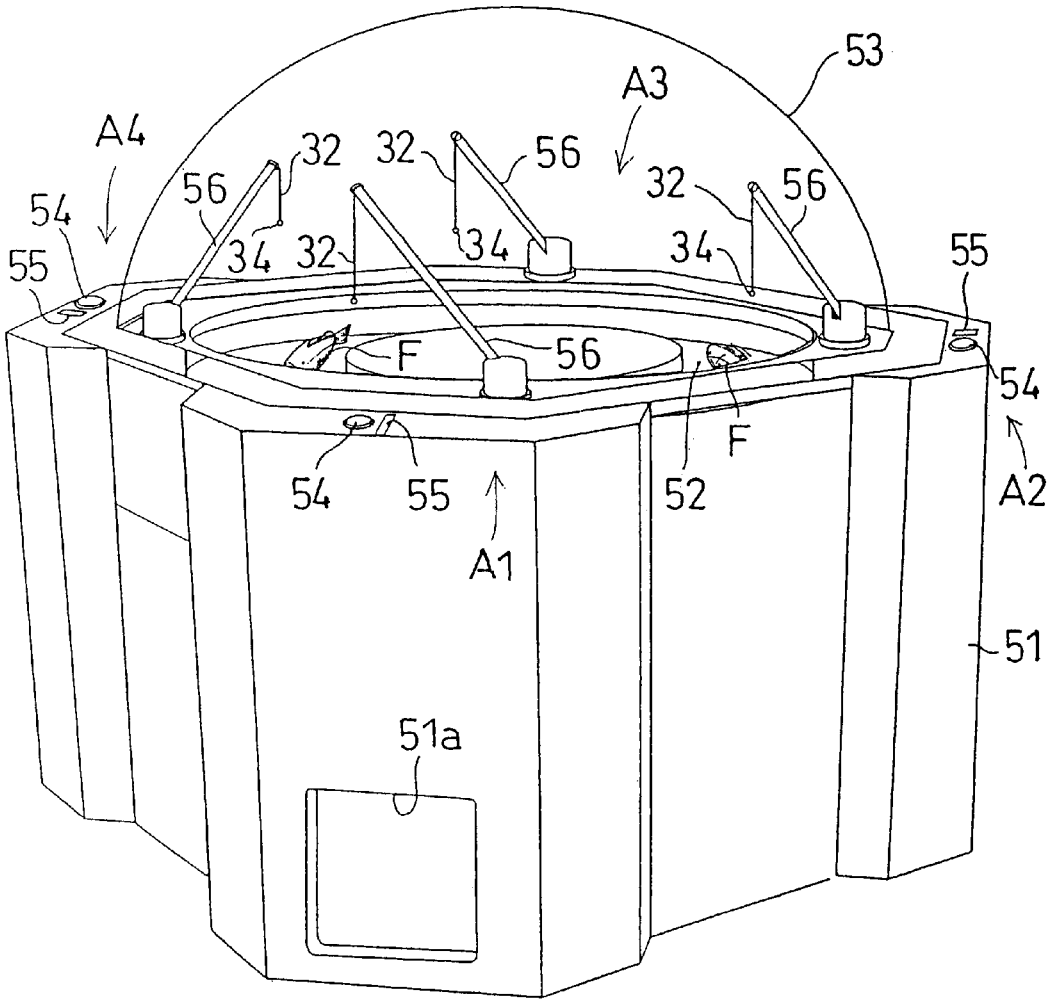
FIG. 7 is a perspective view showing a game machine according to a second embodiment of the present invention.

With reference to FIG. 7, a water tank 52 is arranged in a base 51. A dome 53 covers the top of the base 51 and the water tank 52. In the same manner as the first embodiment, fishes F float on the water surface in the water tank 52. Four areas A1–A4 are defined relative to the base 51 in the same manner as the first embodiment. A button 54 and a coin insertion slot 55 are provided for each of the four areas A1–A4 in the same manner as the first embodiment. A prize discharge port 51*a* is provided for each of the four areas A1–A4 at a lower portion of the base 51.

Fishing rods 56 are arranged about the water tank 52 in the dome 53. Each of the four areas A1–A4 is provided with one of the fishing rods 56. Each fishing rod 56 is made of a metal pipe or the like. A line 32 is inserted through the hollow portion of the fishing rod 56. A ball 34 is secured to one end of the line 32.

Figure 8:
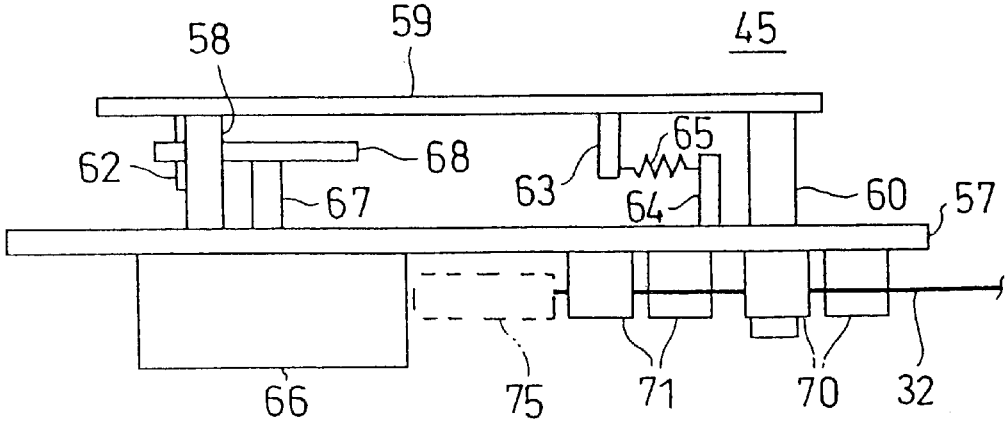
FIG. 8 is a plan view showing a lever plate, a lever, and a cam.
Figure 9:
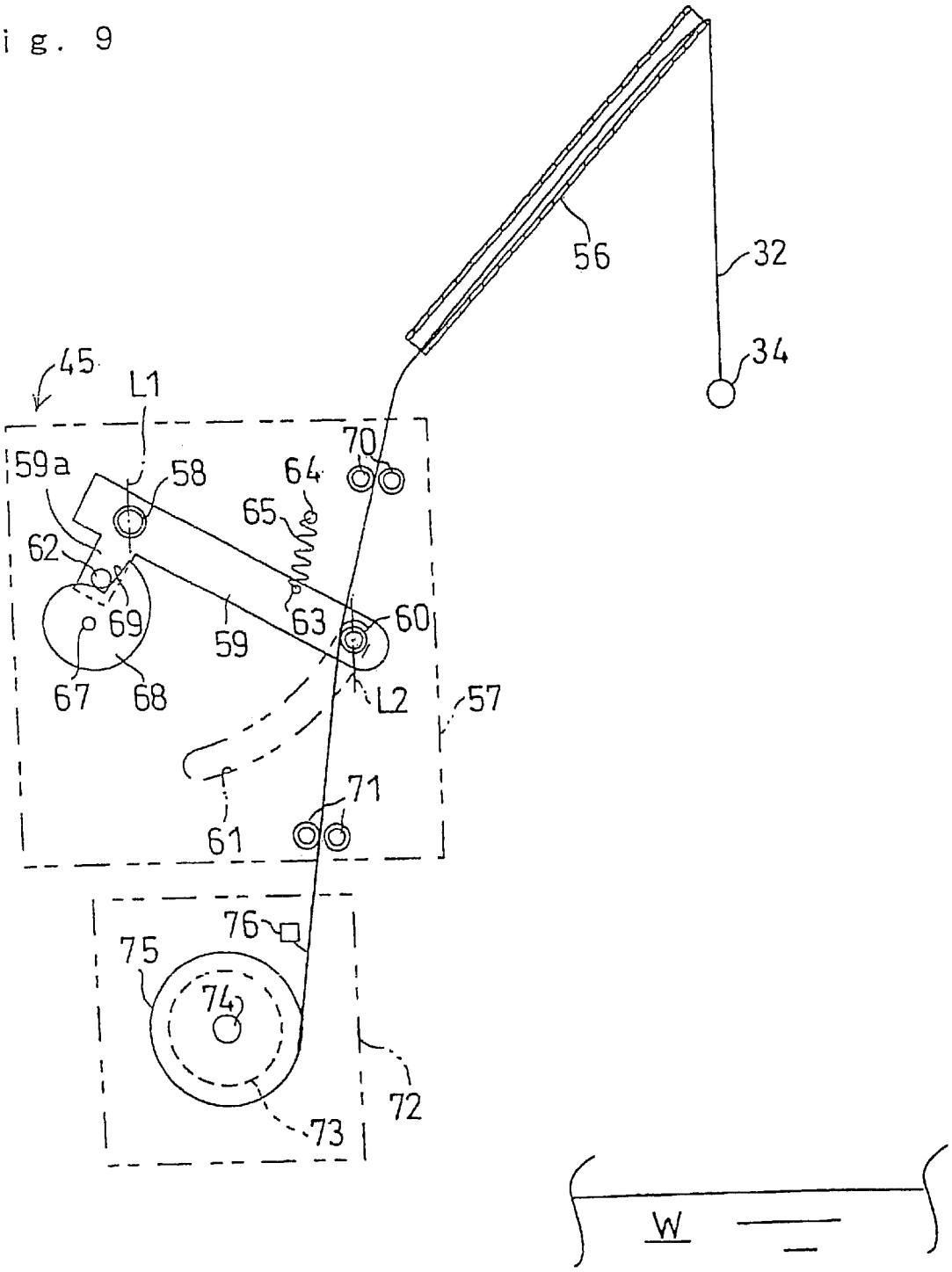
FIG. 9 is a schematic front view showing the lever, a reel, and a fishing line.

Referring to FIGS. 8 and 9, each fishing rod 56 is provided with a disengagement device 45, which is arranged in the base 51. The disengagement device 45 includes a base plate 57. A pivot shaft 58 connected to the base plate 57 pivotally supports a lever 59. A guide pin 60 is supported at the distal end of the lever 60. The guide pin 60 is inserted through an elongated hole 61, which extends through the base plate 57, to project from the opposite side of the base plate 57. The elongated hole 61 of the base plate 57 is formed to match the path of the guide pin 60 when the lever 61, is pivoted.

An extension 59*a* extends from the basal portion of the lever 59. A cam follower 62 projects from the extension 59*a* toward the base plate 57. FIG. 9 shows a vertical axis L1 extending downward from the center of the pivot shaft 58. The cam follower 62 is located on the left side of the vertical axis L1 at a position lower than the pivot shaft 58. A first pin 63 extends from the lever 59 toward the base plate 57. A second pin 64 extends toward the lever 59 from the base plate 57. The first and second pins 63, 64 are connected to each other by a spring 65. The force of the spring 65 constantly urges the lever 59 in a counterclockwise direction, as viewed in FIG. 9.

A motor 66 is secured to the base plate 57. The motor 66 has a shaft 67 that projects from the plate 57 toward the lever 59. A cam plate 68 is secured to the motor shaft 67. Two eccentric circles, which have different radii, define the periphery of the cam plate 68. Thus, the distance between the shaft 67 and the periphery of the cam plate 68 varies in a continuous manner. A cutaway portion 69 is defined at a peripheral part of the cam plate 68. The cam follower 62 contacts the peripheral surface of the cam plate 68. The cam plate 68 is rotated in one direction (clockwise direction as viewed in FIG. 9). When the lever 59 is located at a standby position, the state of which is shown in FIG. 9, the cam follower 62 is in contact with the cutaway portion 69. The location of the cam follower 62 in the state of FIG. 9 will hereafter be referred to as a bottom dead center position. When the lever 59 is located at a position shown in the state of FIG. 12, the cam follower 62 is in contact with the cam plate 68 at a position furthest from the rotating axis of the cam plate 68. The location of the cam follower 62 in the state of FIG. 12 will hereafter be referred to as a top dead center position. When the cam follower 62 is located at the bottom dead center position of FIG. 9, the lever 59 is urged in an upward direction (counterclockwise direction) and thus lifted. Contact between the guide pin 60 and the wall of the elongated hole 61 restricts the pivoting amount of the guide pin 60. A pair of guide rollers 70 are connected to the base plate 57 above the elongated hole 61, and a pair of guide rollers 70 are connected to the base plate 57 below the elongated hole 61.

As shown in FIG. 9, a reel plate 72 is arranged below the base plate 57. A motor 73 is fixed to the reel plate 72. A reel 75 is connected to a shaft 74 of the motor 73. A basal end of the line 32, which extends through the fishing rod 56, is secured to the reel 75. The line 32 is held between each pair of the guide rollers 70, 71, which are located between the reel 75 and the fishing rod 56. FIG. 9 shows a vertical axis L2 extending downward from the center of the guide pin 60. The line 32 is held between the upper and lower guide rollers 70, 71 and contacts the peripheral surface of the guide pin 60 at the left side of the vertical axis L2. A sensor 76 is attached to the reel plate 72. The sensor 76 detects the tension of the line 32.

Figure 15:
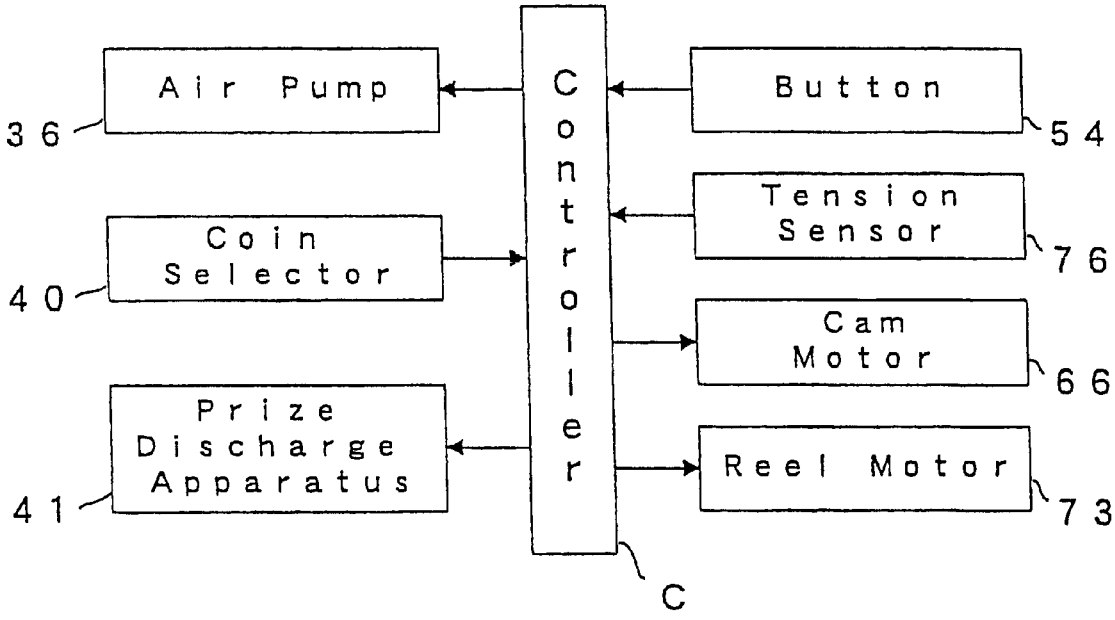
FIG. 15 block view showing the electric structure of the game machine of FIG. 7.

FIG. 15 is a block diagram illustrating the electric structure of the second embodiment. As shown in FIG. 15, a controller C, which performs various controls, is connected to the button 54, the cam motor 66, the reel motor 73, and the sensor 76. In response to an ON signal from any one of the buttons 54, the controller C drives the associated motor 73 and rotates the corresponding reel 74 by a predetermined amount in the counterclockwise direction, as viewed in FIG. 9, to draw the line 32 out of the reel 75 by a predetermined amount. After drawing out the line 32 from the reel 75, the controller C rotates the motor 73 in the reverse direction and winds the line 32 to the reel 75.

If a detection signal input to the controller C by the sensor 76 exceeds a predetermined value when the line 32 is being wound to the reel 75, the controller C drives the prize discharge apparatus 41 to discharge a prize from the associated prize discharge port 51*a*. The controller C also drives the cam motor 66 to rotate the cam plate 68 by a predetermined amount (about 360 degrees) in the clockwise direction.

Figure 10:
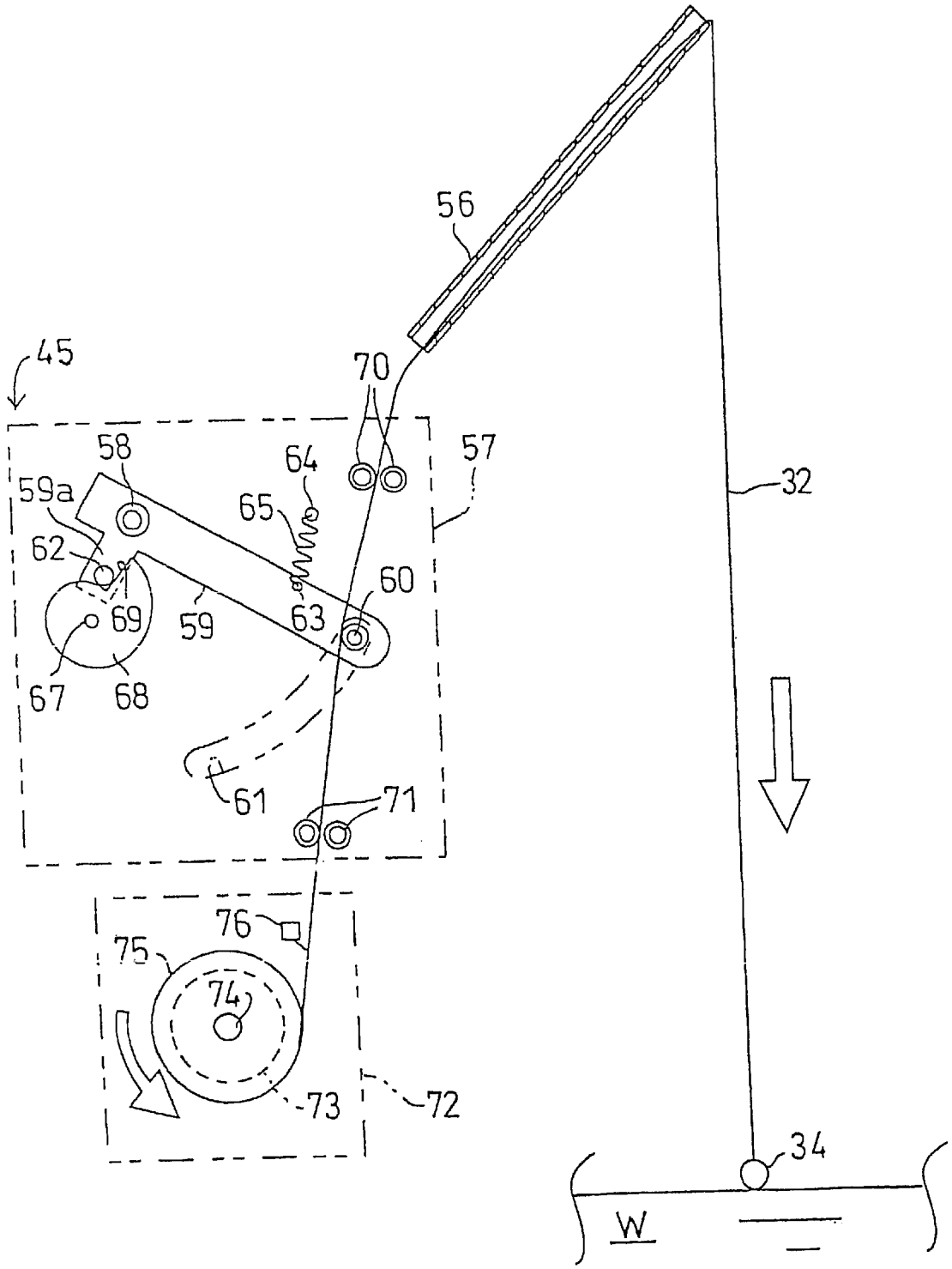
FIG. 10 is a front view showing a state in which a ball is dropped from the state of FIG. 9 on a water surface.
Figure 11:
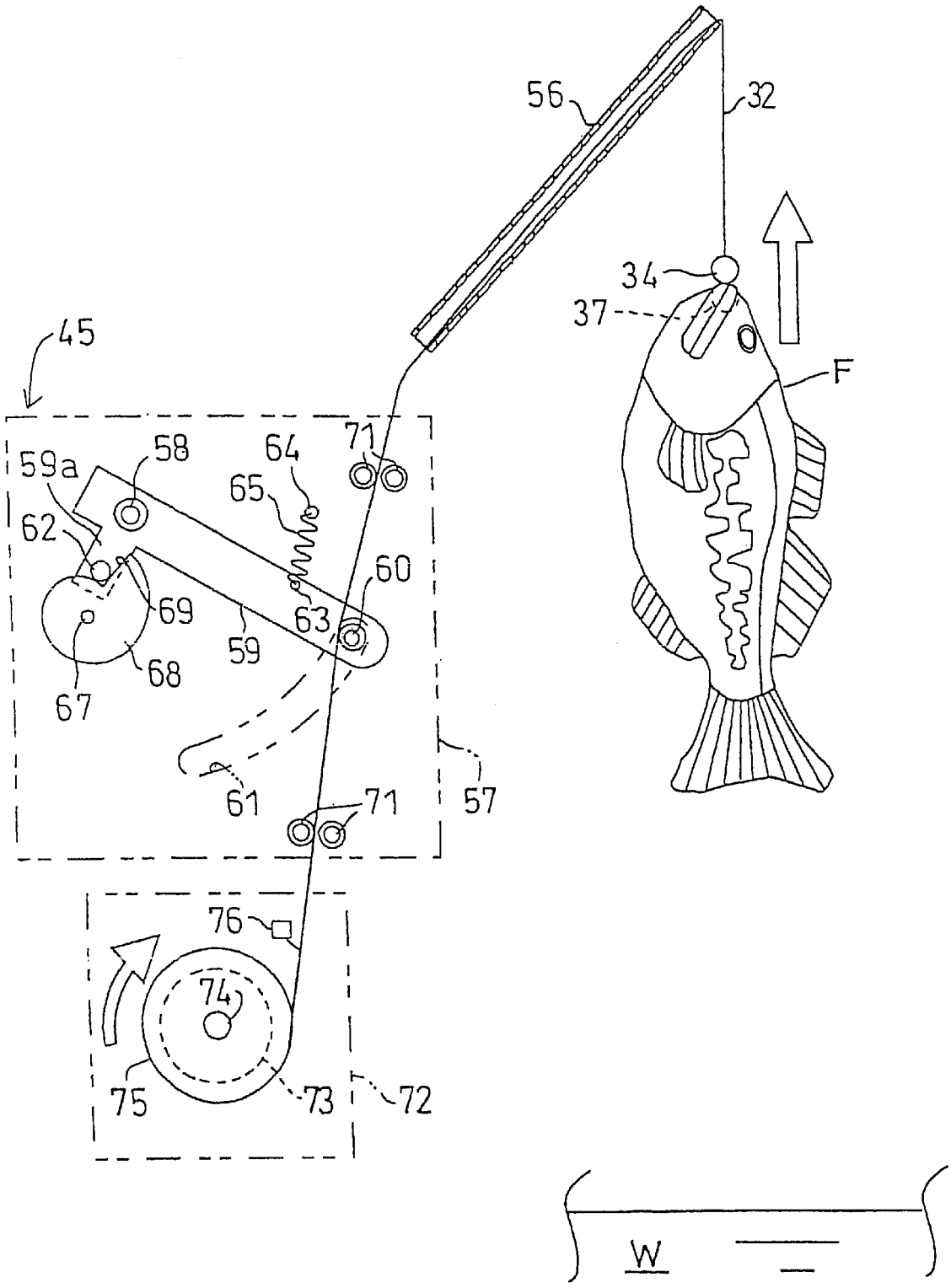
FIG. 11 is a front view showing the reel rotated in a clockwise direction from the state of FIG. 10.

The operation of the second embodiment will now be discussed. In the same manner as the first embodiment, after inserting a coin, a player judges the position of a fish F, which the player decides to fish from the water tank 52, and pushes one of the buttons 54, accordingly. When the player pushes the button 54, the associated reel motor 73 drives the reel 75 in the state of FIG. 9 to draw the line 32 out of the reel 75 and lower the ball 34 until the ball 34 reaches the water W, as shown in the state of FIG. 10. After a predetermined time elapses from when the ball 34 reaches the water W, the reel motor 73 drives the reel 75 in the reverse direction to wind the line 32 to the reel 75 and lift the ball 34 from the water surface. In this state, if a fish F is engaged with the ball 34, the fish F is lifted together with the ball 34, as shown in FIG. 11. Then, when the line 32: is wound by a predetermined amount and the tension detected by the sensor 76 exceeds a predetermined value, the prize discharge apparatus 41 is driven to discharge a prize from the associated prize discharge port 51*a*.

The tension of the line 32 when a fish F is engaged with the ball 34 (a state in which a fish F is caught) is greater than when the ball 34 is free of a fish F (a state in which a fish F is not caught). In other words, the weight of the fish F adds to the tension applied to the line 32. When the detection signal from the sensor 76 exceeds the predetermined value, the controller C determines that a fish F has been caught and discharges a prize.

Figure 12:
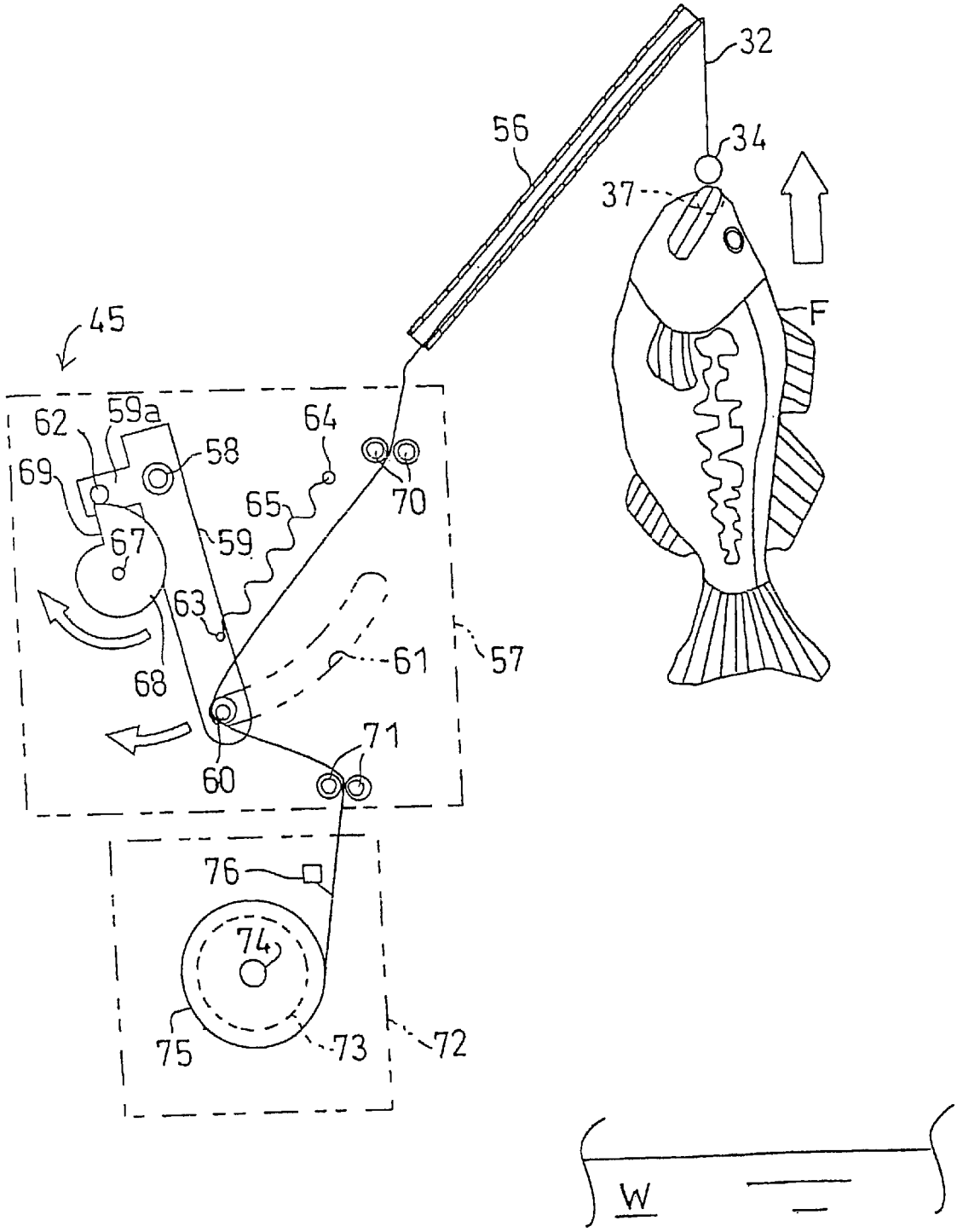
FIG. 12 is a front view showing the cam rotated from the state of FIG. 11 and the lever rotated In a clockwise direction from the state of FIG. 11.

When the fish F is caught and the winding of the line 32 is completed (as shown in the state of FIG. 11), the cam motor 66 rotates the cam plate 68. As the cam plate 68 rotates, the position of the cam follower 62 moves from the bottom dead center position, as shown in the state of FIG. 11, to the top dead center position, as shown in the state of FIG. 12. This pivots the lever 59 in the clockwise direction against the force of the spring 65. When the lever 59 is pivoted, the guide pin 60 pulls the line 32, as shown In FIG. 12, and further lifts the fish F from the state show in FIG. 11.

Figure 13:
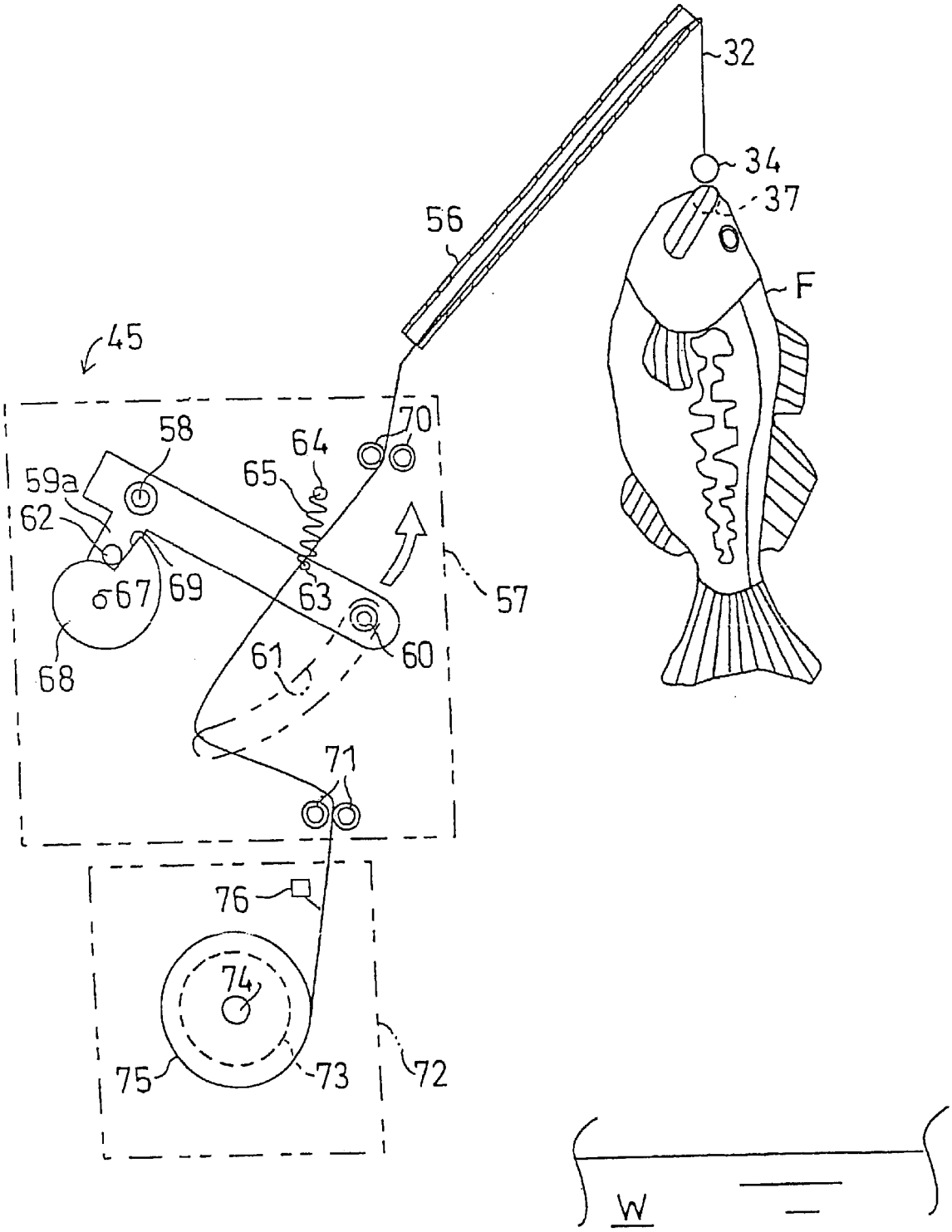
FIG. 13 is a front view showing the cam further rotated from the state of FIG. 12 and the lever returned to its original position.
Figure 14:
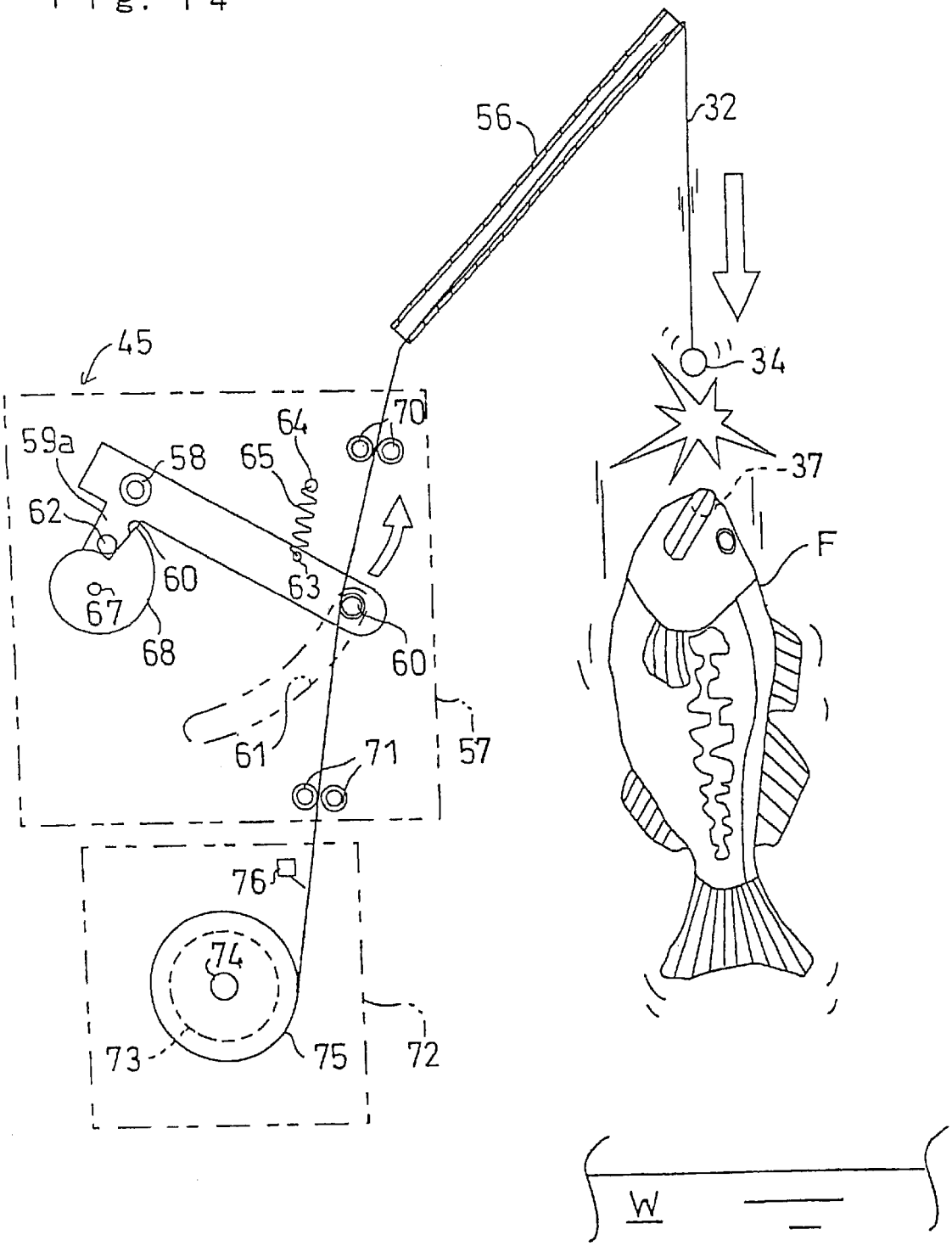
FIG. 14 is a front view showing a fish separated from the ball.

The cam plate 68 is further rotated from the state of FIG. 12. When the cam follower 62 returns to the bottom dead center position, as viewed in FIG. 13, from the top dead center position, the force of the spring 65 returns the lever 59 to the standby position in a sudden manner. The pivoting of the lever 59 momentarily loosens the line 32 and then suddenly tensions the line 32. As a result, the fish F and the ball 34 fall in a sudden manner. The ball 34 falls to the standby position (the position in FIG. 9). Since the ball 34 is secured to the line 32, the ball 34 stops at the standby position. When the ball 34 reaches the standby position, the ball 34 releases and drops the fish F into the water tank 52. More specifically, when the ball 34 falls freely from the position of FIG. 13 to the position of FIG. 9 (FIG. 14), a large amount of tension is applied to the line 32. The tension applied to the line 32 when a fish F is engaged with the ball 34 is greater than that when a fish F is not engaged with the ball 34. In other words, the kinetic energy produced when the ball 34 falls freely with a fish F attached thereto is greater than that when the ball 34 falls freely without a fish F attached thereto. At the moment the ball 34 reaches the standby position, the kinetic energy causes inertial force, which acts to release the fish F from the ball 34, to become greater than the magnetic force, which engages the fish F to the ball. As a result, the fish F is released from the ball 34 and automatically returns to the water tank 52. The fish F floats on the water afterward.

The advantages of the first embodiment are also obtained in the game machine of the second embodiment.

It should be apparent to those skilled in the art that the present invention may be embodied in many other specific forms without departing from the spirit or scope of the invention. Particularly, it should be understood that the present invention may be embodied in the following forms.

In the above embodiments, the fishes F serve as the amusement objects. However, objects having simple shapes, such as spherical objects, cylindrical objects, or cubic objects, may be employed as the amusement objects.

In the above embodiments, the forcible object mover produces a current by forcing air into the water tank 16 with the pump. However, a motor may be employed to vibrate the water tank 16 and produce a current. Alternatively, a screw may be rotated in the water tank 16 to produce the water current.

In the first embodiment, the reels 19, which form the fishing members, are fixed to the associated bars 18. However, the reels 19 may be movably supported so that a drive mechanism moves the reels 19 along the associated bars 18. In such case, an additional button is provided to enable the player to move each reel 19 relative to the associated bar 18 to a desired position. In other words, the game machine may be provided with a mechanism that adjusts the position at which the ball 34 falls from the reel 19. This enables the dropping position of the ball 34 to be adjusted in accordance with the movement of the fishes M and makes the game machine more amusing.

The present examples and embodiments are to be considered as illustrative and not restrictive, and the invention is not to be limited to the details given herein, but may be modified within the scope and equivalence of the appended claims.

What is claimed is:

1. A game machine having a play area partitioned from an external environment, wherein a player manipulates the game machine in the external environment to play a predetermined game while conditions in the play area change, the game machine comprising:

a tank containing liquid;

an amusement object that floats on the surface of the liquid;

a fishing member for engaging the amusement object and fishing the amusement object, wherein the fishing member is lifted to fish the amusement object;

a driving mechanism for supporting the fishing member and vertically moving the fishing member;

a forcible object mover for forcibly moving the amusement object on the liquid surface;

a manipulator manipulated by the player for lowering the fishing member with the driving mechanism; and a dropping mechanism for dropping the amusement object when the amusement object is lifted together with the fishing member by the driving mechanism.

2. The game machine according to claim 1, wherein the forcible object mover sends air into the tank to produce a current and forcibly move the amusement object on the liquid surface.

3. The game machine according to claim 2, wherein the produced current swirls.

4. The game machine according to claim 1, wherein the amusement object is a model fish.

5. The game machine according to claim 4, wherein the model fish has a mouth-like portion, the fishing member engaging the vicinity of the mouth-like portion.

6. The game machine according to claim 1, wherein the dropping mechanism includes a passage restriction member having a hole, and wherein, when the fishing member is lifted, the passage restriction mechanism permits passage of the fishing member and prohibits passage of the amusement object.

7. The game machine according to claim 1, wherein, when the amusement object is engaged with the fishing member, the dropping mechanism temporarily lifts the fishing member and then drops the fishing member by a predetermined distance to cause inertial force to disengage the amusement object from the fishing member.

8. A game machine having a play area partitioned from an external environment, wherein a player manipulates the game machine in the external environment to play a predetermined game while conditions in the play area change, the game machine comprising:

a tank containing liquid;

an amusement object that floats on the surface of the liquid;

a fishing member for magnetically engaging the amusement object and fishing the amusement object, wherein the fishing member is lifted to fish the amusement object;

a driving mechanism for supporting the fishing member and vertically moving the fishing member;

a forcible object mover for forcibly moving the amusement object on the liquid surface;

a manipulator manipulated by the player for lowering the fishing member with the driving mechanism; and a dropping mechanism for dropping the amusement object when the amusement object is lifted together with the fishing member by the driving mechanism.

9. The game machine according to claim 8, wherein the forcible object mover sends air into the tank to produce a current and forcibly move the amusement object on the liquid surface.

10. The game machine according to claim 9, wherein the produced current swirls.

11. The game machine according to claim 8, wherein the amusement object is a model fish.

12. The game machine according to claim 11, wherein the model fish has a mouth-like portion, the fishing member engaging the vicinity of the mouth-like portion.

13. The game machine according to claim 8, wherein the dropping mechanism includes a passage restriction member having a hole, and wherein, when the fishing member is lifted, the passage restriction mechanism permits passage of the fishing member and prohibits passage of the amusement object.

14. The game machine according to claim 8, wherein, when the amusement object is engaged with the fishing member, the dropping mechanism temporarily lifts the fishing member and then drops the fishing member by a predetermined distance to cause inertial force to disengage the amusement object from the fishing member.

15. A game machine having a play area partitioned from an external environment, wherein a player manipulates the game machine in the external environment to play a predetermined game while conditions in the play area change, the game machine comprising:

a tank containing liquid;

an amusement object that floats on the surface of the liquid;

a fishing member for magnetically engaging the amusement object and fishing the amusement object, wherein the fishing member is lifted to fish the amusement object;

a driving mechanism for supporting the fishing member and vertically moving the fishing member;

a forcible object mover for sending air into the tank to produce a current and forcibly moving the amusement object on the liquid surface;

a manipulator manipulated by the player for lowering the fishing member with the driving mechanism; and a dropping mechanism for dropping the amusement object when the amusement object is lifted together with the fishing member by the driving mechanism.

16. The game machine according to claim 15, wherein the produced current swirls.

17. The game machine according to claim 15, wherein the amusement object is a model fish.

18. The game machine according to claim 17, wherein the model fish has a mouth-like portion, the fishing member engaging the vicinity of the mouth-like portion.

19. The game machine according to claim 15, wherein the dropping mechanism includes a passage restriction member having a hole, and wherein, when the fishing member is lifted, the passage restriction mechanism permits passage of the fishing member and prohibits passage of the amusement object.

20. The game machine according to claim 15, wherein, when the amusement object is engaged with the fishing member, the dropping mechanism temporarily lifts the fishing member and then drops the fishing member by a predetermined distance to cause inertial force to disengage the amusement object from the fishing member.

* * * * *